US005197588A

United States Patent [19]

Furuya et al.

[11] Patent Number: 5,197,588

[45] Date of Patent: Mar. 30, 1993

[54] CONTROLLER FOR VENDING MACHINE

[75] Inventors: Yonezo Furuya, Hatoyama; Shusuke Sumi, Tsurugashima, both of Japan

[73] Assignee: Kabushiki Kaisha Nippon Conlux, Tokyo, Japan

[21] Appl. No.: 678,514

[22] Filed: Apr. 1, 1991

[30] Foreign Application Priority Data

Apr. 4, 1990 [JP] Japan ..... 2-89542

[51] Int. Cl.[5] ..... G07F 5/16

[52] U.S. Cl. ..... 194/217; 453/17

[58] Field of Search ..... 194/216, 217, 218; 453/17

[56] References Cited

U.S. PATENT DOCUMENTS 4,347,925 9/1982 Sugimoto et al. .
4,359,147 11/1982 Levasseur .
4,372,464 2/1983 Otten .
4,499,985 2/1985 Schuller ..... 194/217

FOREIGN PATENT DOCUMENTS

A10024150 2/1981 European Pat. Off. .
2097163 10/1982 United Kingdom .

*Primary Examiner*—F. J. Bartuska
*Attorney, Agent, or Firm*—Diller, Ramik & Wight

[57] ABSTRACT

A controller for a vending machine capable of selecting a mode in which the machine is made possible to sell commodities even if change lacks. If a forced acceptance switch sets a forced acceptance mode, put-in coins are accepted even if no change can be paid. When the sum of the put-in coins arrives at a predetermined set selling price, the controller generates a selling enable signal. If the machine sells a commodity in response to the selling enable signal, it pays out change in the range of the sum in which change can be paid or within the sum of the coins remaining in change coin tubes. In this case, if the coins remaining in the change coin tubes do not satisfy the required sum of change, the overall sum of change is not paid out, but a user of the machine can get a desired commodity.

4 Claims, 7 Drawing Sheets

CONTROLLER FOR VENDING MACHINE

BACKGROUND OF THE INVENTION

1. Field of the Invention

The present invention relates to controllers for vending machines and, more particularly, to a controller for a vending machine, wherein a mode for enabling selling of commodities can be selected even when change lacks.

2. Description of the Related Art

Conventionally, a vending machine has an empty detector which detects as lack of change when the coins stored in change coin tubes arrives at a minimum number necessary for paying out the change. It is arranged such that when the empty detector detects the lack of change, all the selling operations involving payment of change are inhibited. Otherwise, payment of change is not ensured, so that a user would suffer from unexpected loss.

However, there may be cases where a person who uses vending machines wishes to buy commodities even if he cannot receive change: for example, in a case where there is no way to buy commodities except from a nearby vending machine; in a case where a nearby vending machine from which he can buy commodities is not in service because of time; and in a case where he somehow wants to get commodities at once even if he may lose small change, etc. Even such cases, the selling operation involving payment of change is completely inhibited when there is no change stored in a conventional vending machine. Therefore, it is impossible for a person to get desired commodities from a conventional vending machine which sells those commodities even though the vending machine is located near him, if he does not have kinds of denominations which do not require change.

SUMMARY OF THE INVENTION

It is an object of the present invention to provide a controller for a vending machine which is capable of setting an operative mode in which the selling operation involving payment of change is ensured even if the machine has insufficient or no change.

In order to achieve the above object, the present invention provides a controller for a vending machine, comprising: a forced acceptance switch for setting a forced acceptance mode; control means for accepting put-in coins if the force acceptance mode is set by the forced acceptance switch even if no change can be paid and generating a selling enable signal when the sum of the put-in coins arrives at a predetermined set selling price; and means for paying change in a range in which change can be paid when a commodity is sold in response to the selling enable signal.

When the forced acceptance mode is set by the forced acceptance switch, the put-in coins are accepted even if no change can be paid. The selling enable signal is generated when the sum of the put-in coins arrives at a predetermined set selling price. If a commodity is sold in response to the selling enable signal, change is paid within an allowable range or in the sum of coins which remain in change coin tubes. In this case, if the coins remaining in the change coin tubes do not reach the required sum of change, full change will not be paid, but a user of the machine gets a desired commodity.

As just described above, according to the present invention, arrangement is such that the operative mode is set in which the selling operation involving payment of some change is permitted even if no satisfactory change is left, so that a user can buy desired commodities even if there is only insufficient or no change prepared to thereby satisfy the user's request to buy commodities even if he does not receive full change.

DESCRIPTION OF THE PREFERRED EMBODIMENTS

One embodiment of the present invention will be described below in more detail with reference to the accompanying drawings.

Figure 1:
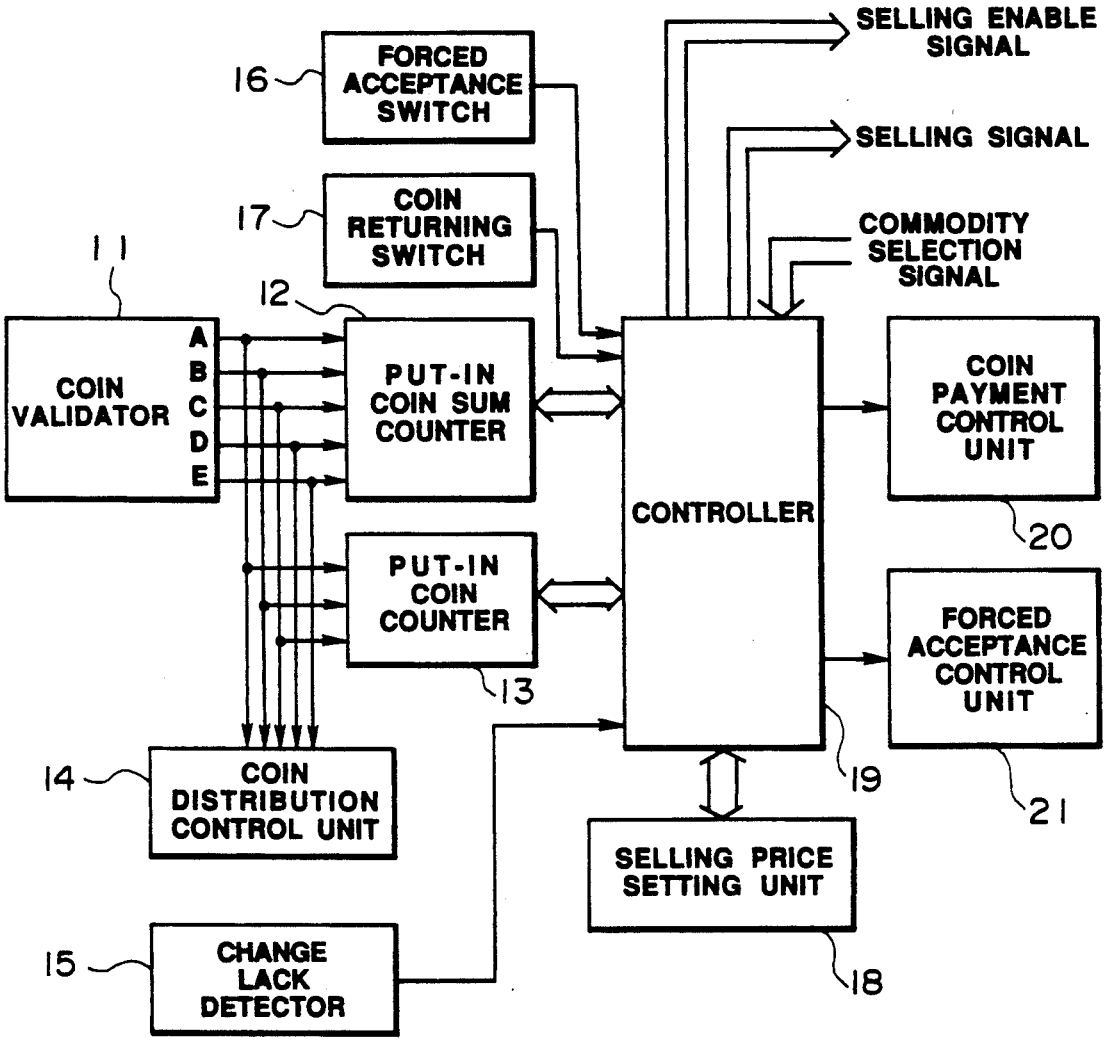
FIG. 1 is a block diagram indicative of one embodiment of a controller for a vending machine according to the present invention.

FIG. 1 is a block diagram of one embodiment of a controller for a vending machine according to the present invention.

Figure 2:
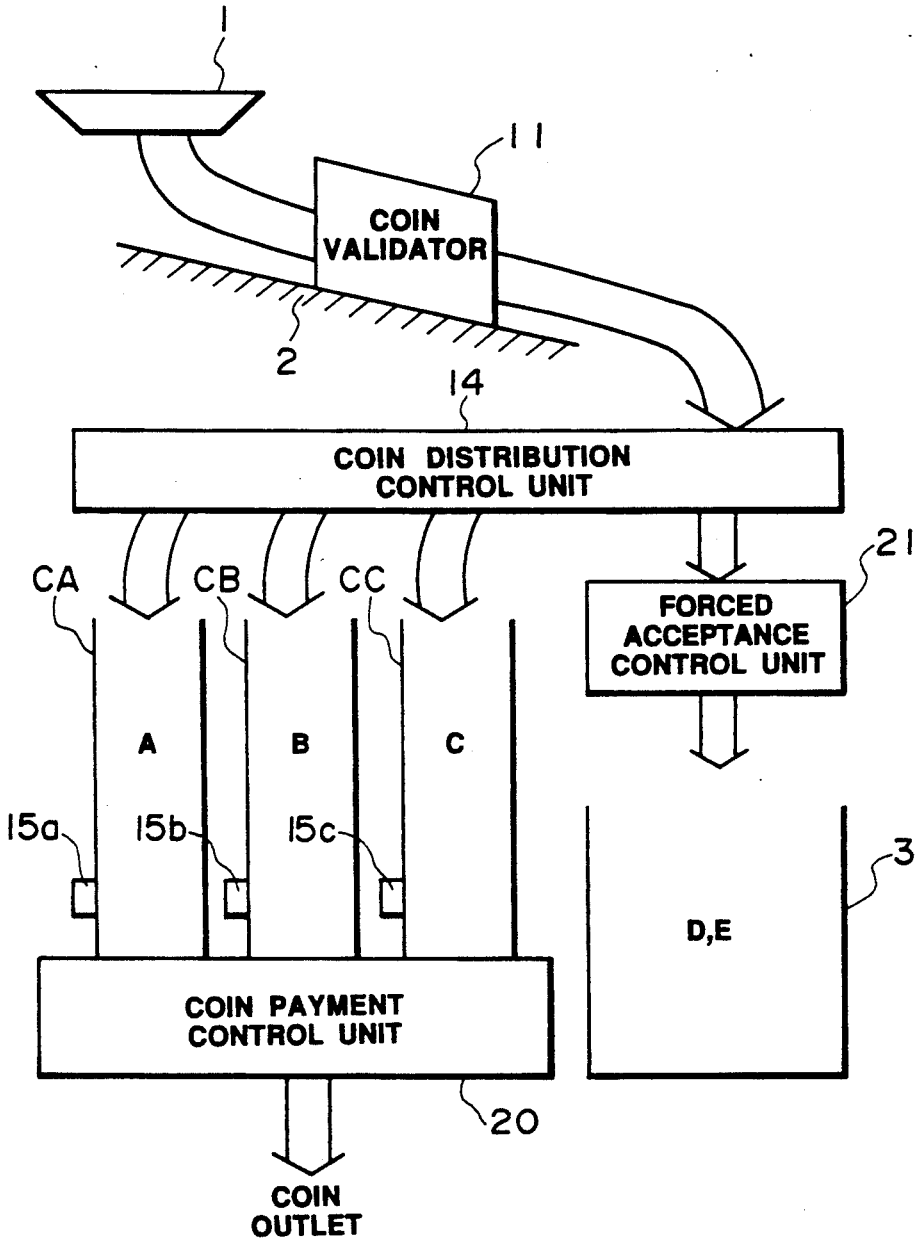
FIG. 2 is a schematic view of a coin selector of a vending machine to which the embodiment of FIG. 1 is applied.

In FIG. 1, a coin validator 11 detects the validations and kinds of put-in coins; in the particular embodiment, five kinds of coins A, B, C, D and E. The coin validator 11 may be a well-known electronic coin validator which detects the validations and kinds of put-in coins on the basis of electromagnetic characteristics of the coins. In the present embodiment, let the coins A, B, C, D and E have denominations PA, PB, PC, PD and PE, respectively. Assume that the relation $PA<PB<PC<PD<PE$ holds. As shown in FIG. 2, the coin validator 11 is disposed along a guide rail 2 which guides a coin put in through a coin slot 1 to a coin distribution control unit 14. If the coin validator 11 detects that the put-in coin is a genuine one, it outputs a pulse signal to one of signal lines corresponding to the kind of the coin. The output from the coin validator 11 is applied to a put-in coin sum counter 12, which counts the pulse signals weighted with the corresponding denominations PA, PB, PC, PD and PE on signal lines corresponding to the respective kinds of the put-in coins to thereby provide the total sum of the put-in coins.

The pulse signals on the signal lines, corresponding to lower denomination coins A, B and C, of signal lines corresponding to the respective kinds of coins output from the coin validator 11 are applied to a put-in coin counter 13, which counts the respective numbers of coins A, B and C to ensure return of coins which is the same in kind as the put-in coins, when required. In the present embodiment, as shown in FIG. 2, the three kinds of lower denomination coins A, B and C of the usable coins A, B, C, D and E are guided into change coin tubes CA, CB and CC, respectively, while other higher denomination coins D and E are directly guided into a cash box 3 through a forced acceptance control unit 21. When change is to be paid, and the coins are to be returned, a coin payment control unit 20 is driven to pay out change to return coins from the change coin tubes CA, CB and CC to a coin outlet (not shown). In the present embodiment, the respective numbers of three kinds of lower denomination coins A, B and C used for a returning purpose are stored. The coins are returned, if necessary, in accordance with the stored numbers of put-in coins to thereby realize the return of coins which are the same in kind as the put-in coins. As will be obvious from a later description, the arrangement of this embodiment is such that if at least one of the higher denomination coins D and E is put in, returning those coins is inhibited and no higher denomination coins are returned.

A signal indicative of each of the kinds of the coins output from the coin validator 11 is delivered to a coin distribution control unit 14, which distributes the put-in coins to the change coin tubes CA, CB and CC or to the cash box 3 in accordance with the kinds of the put-in coins on the basis of the output of the coin validator 11. The coin distribution control unit 14 may be a well-known coin distributor which uses passage selection by a solenoid, mechanical distribution depending on the diameter of the put-in coin or by mechanical distribution using the coefficient of restitution (rebound) of a coin. When the change coin tubes CA, CB and CC are filled with the put-in coins, and the distributed coins overflow, the overflowing coins are guided into the cash box 3 through a passageway (not shown).

A change lack detector 15 detects a fact that the quantity of coins in the change coin tubes CA, CB and CC is insufficient to pay out change. As shown in FIG. 2, the change lack detector 15 includes three empty switches 15*a*, 15*b* and 15*c* disposed at predetermined positions in the respective change coin tubes CA, CB and CC. When each of the number of the coins in the respective tubes CA, CB and CC reaches to a number which corresponds to each of the positions where the empty switches 15*a*, 15*b* and 15*c* are located, the switches 15*a*, 15*b* and 15*c* detect these facts, respectively. The change lack detector 15 determines on the result of the detection whether change can be made by combining the coins remaining in the change coin tubes CA, CB and CC. If not, it outputs an empty signal indicating that there is no change therein.

A forced acceptance switch 16 is provided by this invention. When the switch 16 is switched on, the forced acceptance control unit 21 is set to an acceptance mode to thereby forcedly put the put-in higher denomination coins D and/or E into the cash box 3 irrespective of whether there is change (irrespective of whether an empty signal from the change lack detector 15 is output). If there is no change, payment of change is not ensured. Thus, the maximum possible sum which can be paid out with the coins in the tubes CA, CB, CC is paid out as change when required. If the forced acceptance switch 16 is off, the forced acceptance control unit 21 is set in an acceptance state only when there is change, and the put-in higher denomination coins D and/or E are accepted by the cash box 3. If change lacks, the forced acceptance control unit 21 is put in a rejection state, so that the put-in higher denomination coins D and/or E are returned from a coin outlet (not shown) through a coin passageway (not shown).

A coin returning switch 17 is operated when the entire sum of the put-in coins is required to be returned without commodities being bought. In the present embodiment, if at least one of the higher denomination coins D and E is put in, coin returning is inhibited, so that no coins are returned even if the coin returning switch 17 is operated after the higher denomination coin D or E is put in.

A selling price setting unit 18 is used to set the respective selling prices SPi of a plurality of commodities to be sold by the vending machine. Setting of selling price in the selling price setting unit 18 is performed by a dip switch or a ten key unit (not shown).

A controller 19 provides controls over the entire system. More particularly, it provides: selling control in which when the count of the put-in coin sum counter 12 arrives at the selling price SPi set in the selling price setting unit 18, the control unit 19 out puts a selling enable signal to enable to sell commodities corresponding to the selling price SPi to a vending unit (not shown) which controls the supply of commodities, and, when a commodity selection signal is sent from the vending unit by selecting a commodity for which the selling enable signal is output, the controller sends to the vending unit a selling signal to start selling the commodity in response to the commodity selling signal; control of payment of change in which change is calculated after the commodity was sold, a coin payment control unit 20 is controlled in accordance with the result of the calculation to pay out change; coin returning control in which the coin payment control unit 20 is controlled in response to the operation of the coin returning switch 17 to pay out coins corresponding to the put-in coins on the basis of the respective counts of the coins in the put-in coin counter 13; and control over the forced acceptance control unit 21 in accordance with the operation of the forced acceptance switch 16.

The coin payment control unit 20 controls payment of change, as mentioned above, and returning coins under control of the controller 19 while the forced acceptance control unit 21 controls forced acceptance of the higher denomination coins D, E into the cash box 3, as will be described in more detail later.

Figure 3:
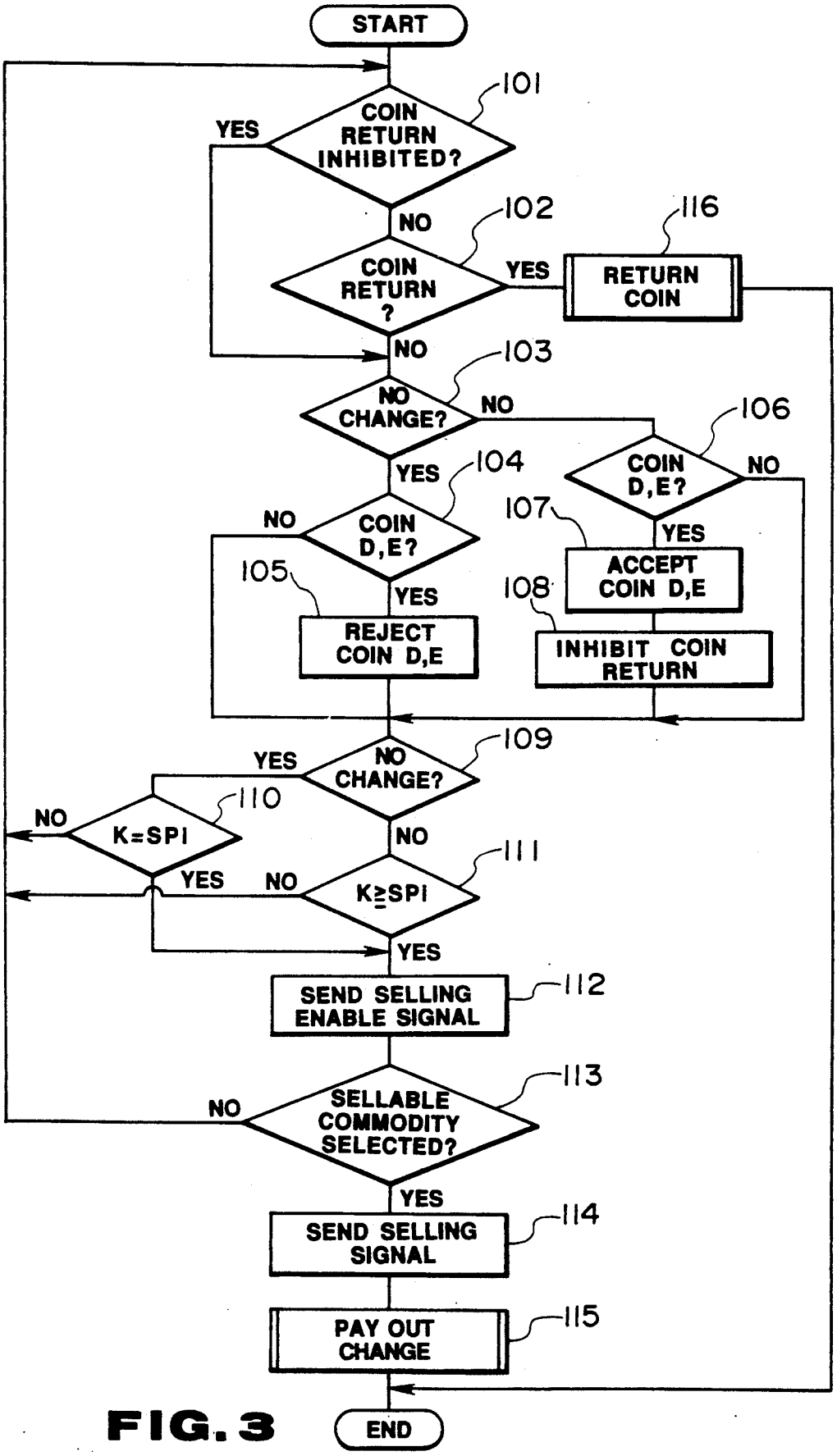
FIG. 3 is a flowchart indicative of the operation of the controller performed when a forced acceptance switch of the FIG. 1 embodiment is switched off.

The operation of the controller will be described in more detail with reference to the flowcharts of FIGS. 3 through 7. FIG. 3 illustrates the operation of the controller 19 when the forced acceptance switch 16 is off. First, the controller 19 checks whether there is a coin return inhibiting flag formed in response to putting-in of the higher denomination coins D, E to be described later in more detail (step 101). If there is no coin return inhibiting flag, the controller checks whether the coin returning switch 17 is operated (step 102). If there is the coin return inhibiting flag or if the coin returning switch 17 is not operated even if there is the coin return inhibiting flag, the controller checks on the basis of the output of the change lack detector 15 whether change lacks (step 103).

If change lacks, the controller controls the forced acceptance control unit 21 such that if the put-in coins are the higher denomination coins D, E (step 104), it rejects the acceptance of the coins D, E (step 105) and automatically returns them through the coin outlet.

If change does not lack, the controller controls the forced acceptance control unit 21 such that if those put-in coins are the higher denomination coins D, E (step 106), it causes the put-in coins to be accepted (step 107). In this case, the coin return inhibiting flag is formed in order to inhibit a possible subsequent coin returning operation (step 108).

The controller then checks whether change lacks (step 109). If so, it compares a count K in the put-in coin sum counter 12 with the set selling price SPi in the selling price setting unit 18 to see if K=SPi holds (step 110). If there is a commodity for which K=SPi holds, the controller sends a selling enable signal for that commodity (step 112).

If change exists, the controller checks whether there is a commodity for which K≧SPi holds with respect to the count K in the put-in coin sum counter 12 and the set selling price SPi in the selling price setting unit 18 (step 111). If there is a commodity for which K≧SPi holds, the selling enable signal is sent for that commodity (step 112).

When the vending unit selects a commodity in response to the selling enable signal and sends a selection signal (step 113), the controller sends to the vending unit a selling signal indicative of the start of selling the selected commodity (step 114), and then controls the coin payment control unit 20 so as to pay out change (step 115).

Figure 4:
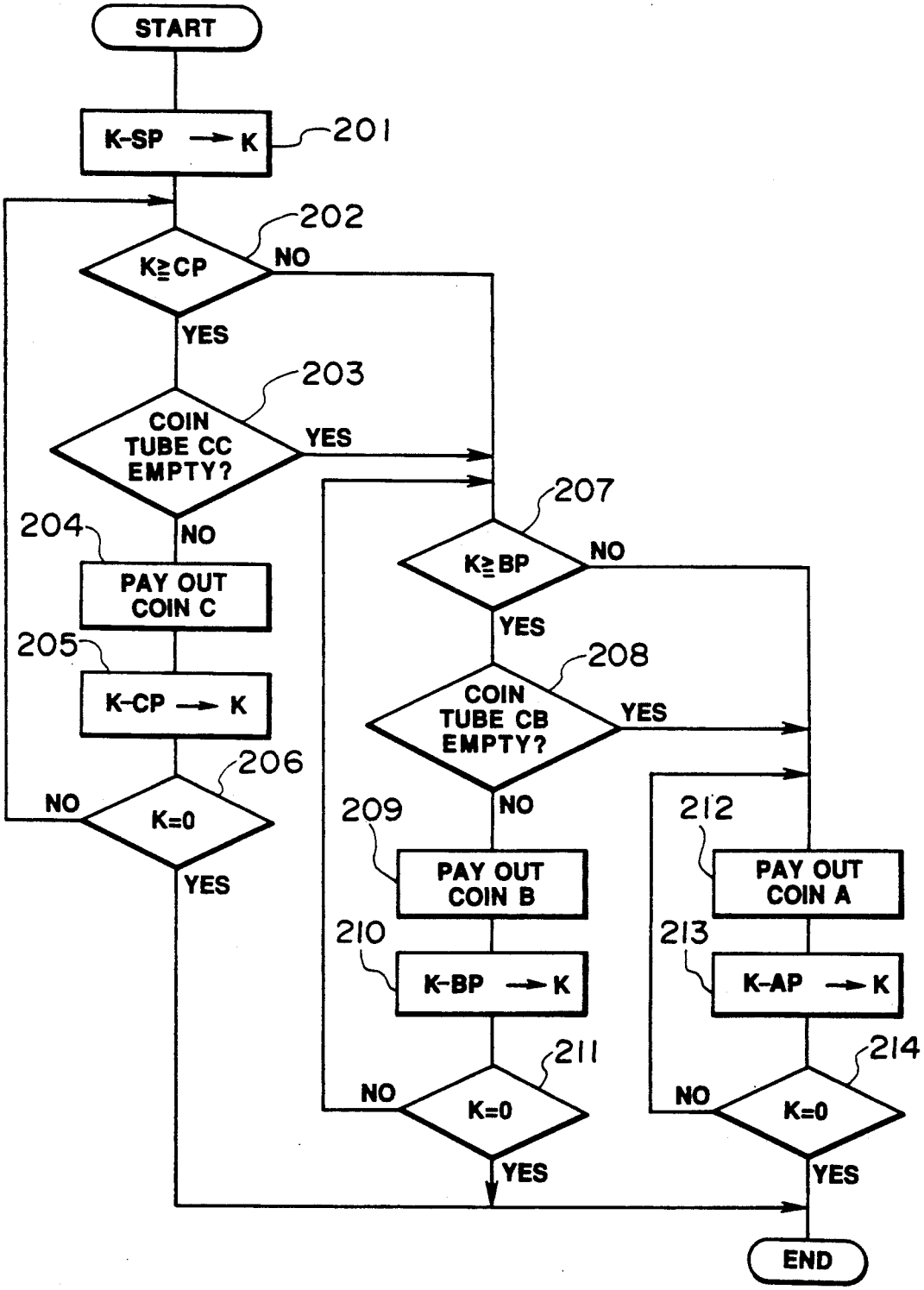
FIG. 4 is a flowchart indicative of the details of the change payment operation in the flowchart of FIG. 3.

The details of the change payment operation at step 115 is shown in FIG. 4. First, the controller subtracts the selling price SP of the sold commodity from the count K in the put-in coin sum counter 12 and employs the result as a new count K in the put-in coin sum counter 12 (K−SP→K) to thereby make the count K in the counter 12 equal to the sum of the change (step 201).

The controller then compares the sum of the change K (count K in the counter 12) with the denomination CP of coin C to check whether K≧CP holds or whether coins C are needed for change payment (step 202). If K≧CP holds, it checks whether the coin tube CC which stores coin C is empty or not (step 203). If the coin tube CC is not empty, the controller controls the coin payment control unit 20 to pay out one coin C from the coin tube CC (step 204), subtracts the denomination sum CP of coin C from the count K in the counter 12 and employs the result as a new count K in the counter 12 (K−CP→K) (step 205). Subsequently, the controller checks whether the count K in the counter 12 is 0 (K=0) (step 206). If not, the controller returns to step 202 to repeat the above operations. If K≧CP does not hold at step 202, or if the coin tube CC which stores coins C is determined to be empty at step 203, the controller compares the count K in the counter 12 with the denomination BP of coin B to see if K≧BP or coins B are required for change payment (step 207). If K≧BP, it checks whether the coin tube CB which stores coins B is empty (step 208). If not, the controller controls the coin payment control unit 20 to pay out one coin B from the coin tube CB (step 209), subtracts the denomination sum BP of coin B from the count K in the counter 12, and employs the result as a new count K in the counter 12 (K−BP→K) (step 210). Subsequently, the controller checks whether the count K in the counter 12 is 0 (K=0) (step 211). If not, the controller returns to step 207 and repeats the above operations.

If K≧BP does not hold at step 207, or if the coin tube CB which stores coin B is determined to be empty at step 208, the controller causes coins A to be paid out from the coin tube CA which stores coins A. In this case, the controller first pays out one coin A (step 212), subtracts the denomination sum AP of coin A from the count K in the counter 12 and employs the results as a new count K in the counter 12 (K−AP→K) (step 213). Subsequently, the controller checks whether the count K in the counter 12 is 0 (K=0) (step 214). If not, the controller returns to step 212 and repeats the above operations.

If this way, if K=0 holds at steps 206, 211 or 214, the change payment operation ends.

Figure 5:
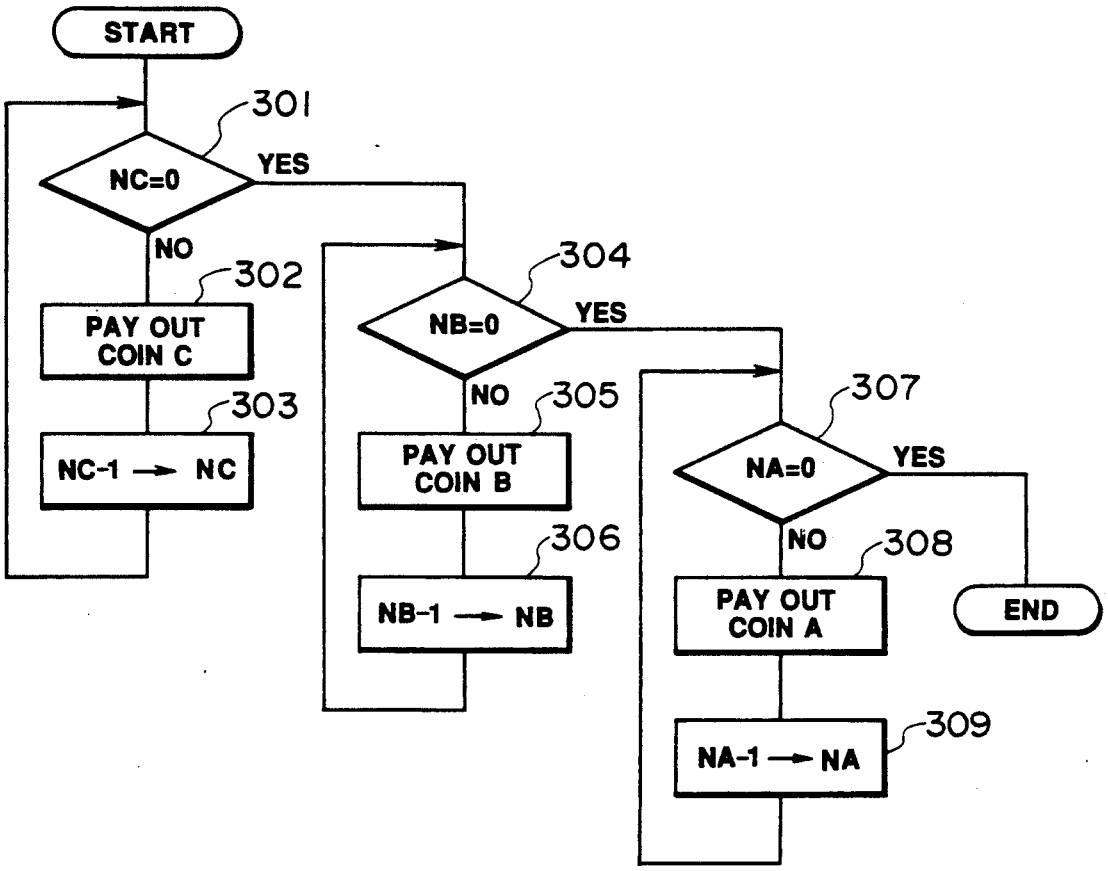
FIG. 5 is a flowchart indicative of the money returning operation of the flowchart of FIG. 3.

If the coin returning switch 17 is operated and a coin return command is given at step 102 in FIG. 3, the coin returning operation is performed. The details of the coin returning operation is shown in FIG. 5. In this coin returning operation, the controller controls the coin payment control unit 20 on the basis of the respective put-in numbers NC, NB and NA of the lower denomination coins A, B and C (stored in the coin tubes) counted by the put-in coin counter 13 to pay out coins A, B and C. First, the controller checks whether the put-in number NC of coins C counted by the put-in coin counter 13 is 0 (NC=0) (step 301). If not, the controller pays out one coin C from the coin tube CC (step 302), sub tracts one from the put-in number NC of coins C in the counter 13 and employs the result as a new put-in number NC of coins C (NC−1→NC) (step 303) and repeats these operations until NC=0 holds. If NC=0 holds at step 301, which means that coins C equal in number to the put-in coins C have been paid out, coins B are then paid out from the coin tube CB.

First, the controller checks whether the put-in number NB of coins B counted by the counter 13 is 0 (NB=0) (step 304). If not, the controller pays out one coin B from the coin tube CB (step 305), subtracts one from the put-in number NB of coins B in the put-in coin counter 13 and employs the result as a new put-in number NB (NB−1→NB) (step 306) and repeats these operations until NB=0. If NB=0 holds at step 304, which means that coins B equal in number to the put-in coins B have been paid out, coins A are then paid out from the coin tube CA.

In the payment of coins A, first, the controller checks whether the put-in number NA of coins A counted by the counter 13 is 0 (NA=0) (step 307). If not, the controller pays out one coin A from the coin tube CA (step 308), subtracts one from the put-in number NA of coins A in the put-in coin counter 13 and employs the result as a new put-in number NA (NA−1→NA) (step 309) and repeats these operations until NA=0 holds. If NA=0 holds at step 307, which means that coins A equal in number to the put-in coins A have been paid out, so that the coin returning operation ends.

The operation of the controller 19 performed when the forced acceptance switch 16 is switched on will next be described. When the switch 16 is switched on, the forced acceptance control unit 21 is set in a coin acceptance state irrespective of whether change lacks.

Figure 6:
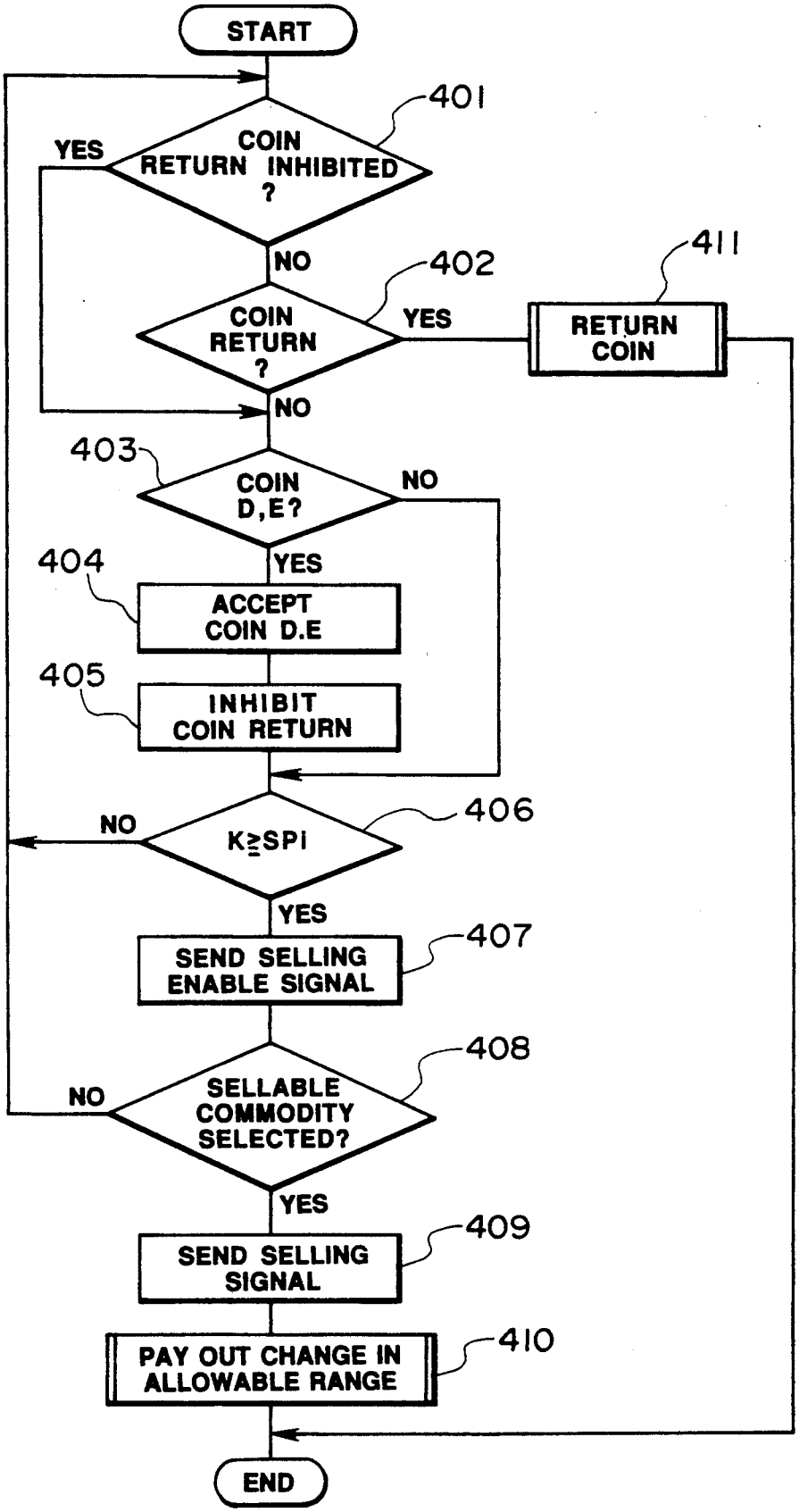
FIG. 6 is a flowchart indicative of the operation of the controller performed when the forced acceptance switch is switched off in the FIG. 1 embodiment.

FIG. 6 shows the operation of the controller 19 performed when the switch 16 is switched on. First, the controller checks whether there is the coin return inhibiting flag formed in response to putting-in of the higher denomination coins D, E (step 401). If not, the controller checks whether the coin returning switch 17 is operated (step 402). If the coin return inhibiting flag is formed or if the coin return switch 17 is not operated even if the coin return inhibiting flag is formed, the controller checks whether the put-in coins are the higher denomination coins D, E (step 403). If so, the controller causes the coins D, E to be accepted through the forced acceptance control unit 21 into the cash box 3 (step 404). The coin return inhibiting flag is then formed in order to inhibit a possible subsequent coin returning operation (step 405).

The controller then checks whether K≧SPi holds with respect to the count K in the put-in coin sum counter 12 and the set selling price SPi in the selling price setting unit 18 (step 406). If there is a commodity for which K≧SPi holds, the controller outputs a selling enable signal for that commodity (step 407).

If the vending unit selects a commodity in response to the selling enable signal and sends a selection signal (step 408), the controller sends to the vending unit as a selling signal commanding the start of selling the selected commodity (step 409), and then controls the coin payment control unit 20 to pay out change (step 410). In this case, payment of change is not ensured, so that change is paid at step 410 with the maximum sum payable within the remaining sum of the coins in the coin tubes CC, CB and CA.

Figure 7:
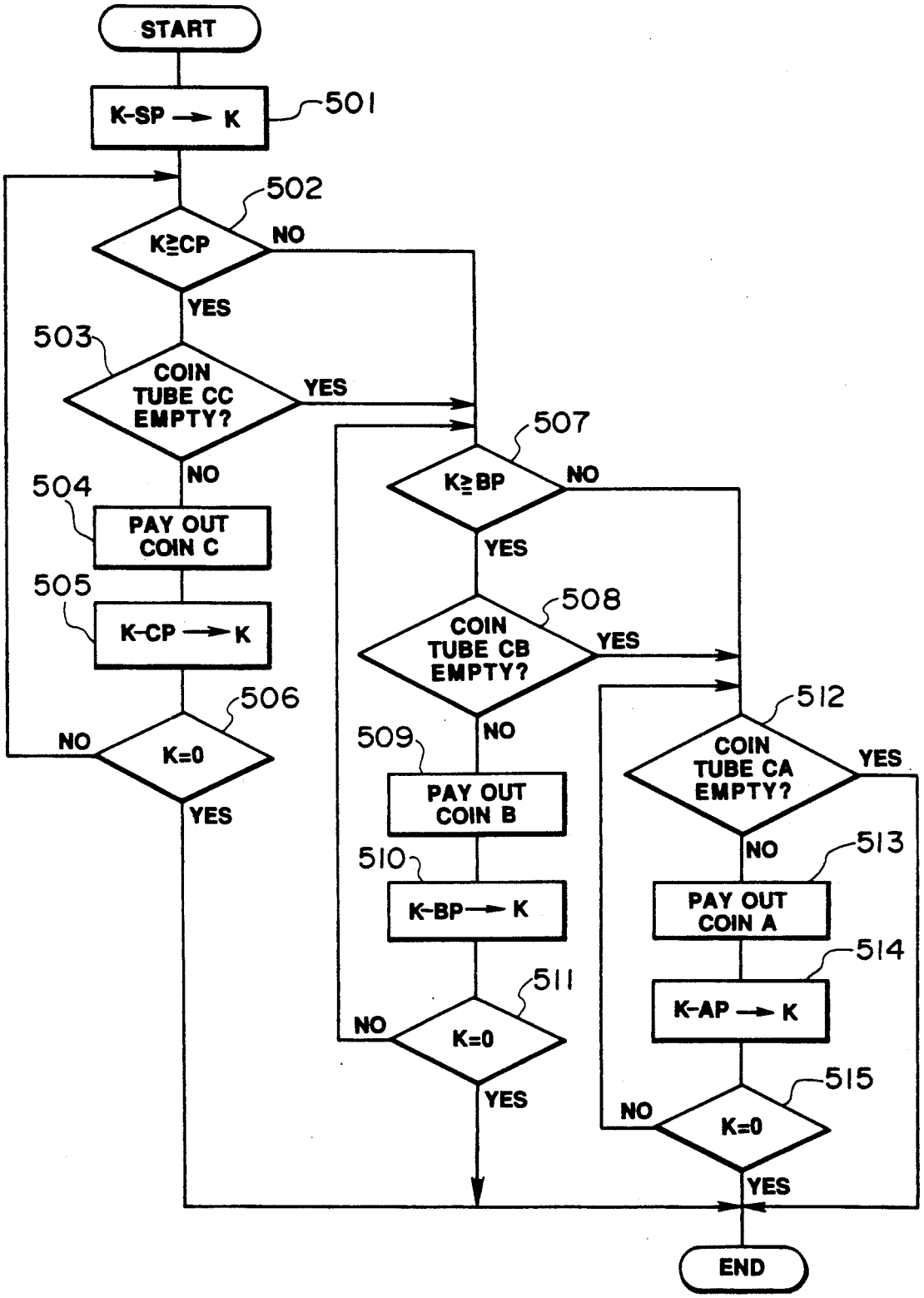
FIG. 7 is a flowchart indicative of the details of the change payment operation in the flowchart of FIG. 6.

The details of the change payment operation performed in this case is shown in FIG. 7. In this case, when the coin tube CA is empty and no more change can be paid, the change payment operation is ended even if K is not equal to 0 while the change payment operation does not end until K=0 in the operation of FIG. 4. In the former case, when the forced acceptance switch 16 is off, selling is enabled after it is confirmed that change can be paid. Therefore, payment of change is ensured. When the forced acceptance switch 16 is on, payment of change is not ensured, so that it is unclear whether change is paid. Therefore, even if K=0 does not hold, change payment is terminated when the minimum denomination coins A lack. More particularly, the controller subtracts the selling price SP of the sold commodity from the count K in the counter 12, employs the result as a new count K in counter 12 (K−SP→K) (step 501). If K≧CP (step 502) holds, the controller checks whether the coin tube CC is empty (step 503). If not, the controller pays out one coin C (step 504), subtracts the value CP from the value K and employs the result as a new value K (K−CP→K) (step 505). Subsequently, the controller checks whether K=0 (step 506) holds. If not, the controller returns to step 502 and repeats the above operations.

If K≧CP does not hold at step 502, or if the controller determines at step 503 that the coin tube CC is empty, it checks whether K≧BP (step 507) holds. If so, the controller checks whether the coin tube CB is empty (step 508). If not, it pays out one coin B (step 509), subtracts the value BP from the value K and employs the result as a new value K (K−BP→K) (step 510). Subsequently, the controller checks whether K=0 (step 511) holds. If not, the controller returns to step 507 and repeats the above operations.

If K≧BP does not hold at step 507 or if the controller determines at step 508 that the coin tube CB which stores coins B is empty, it checks whether the coin tube CA which stores coins A is empty (step 512). If not, the controller pays out one coin A (step 513), subtracts the value AP from the value K and employs the result as a new value K (K−AP→K) (step 514). Subsequently, the controller checks whether K=0 holds (step 515). If not, the controller returns to step 512 and repeats the above operations.

In this way, if K=0 holds at step 506, 511 or 515, the change payment operation ends. If the controller determines at step 512 that the coin tube CA for storing coins A is empty even if K=0 does not hold at step 515, no more change can be paid, so that the change payment operation ends.

The coin returning operation performed when the coin returning switch 17 is operated and the controller determines that the coin return command is issued at step 402 of FIG. 6 is similar to that shown in FIG. 5.

While in the above embodiment, paying out of coins of respective denominations has been described as being controlled such that the change sum K in the put-in coin sum counter 12 becomes 0 in the change payment operation, arrangement may be such that the paid-out numbers of coins having the corresponding denominations are previously calculated before the change payment operation starts and then the coins of the corresponding denominations are paid out.

More particularly, when let the change sum be K and let change coins C, B and A have denominations CP, BP and AP, respectively, a paid-out number KC of coins C is calculated from the operation R/BP, K−(CP×KC) is calculated to obtaine R, a paid-out number KB of coins B is calculated from the operation R/BP, R−(BP×KB) is calculated to obtain R', and a paid-out number KA of coins A is calculated from the operation R'/AP. In the coin payment operation, change is paid on the basis of the paid-out numbers KC, KB and KA of the coins C, B and A with the corresponding denominations as calculated beforehand.

While in the above embodiment the operation with five usable kinds of coins has been described, the number of usable kinds of coins is not limited to five, of course. A similar arrangement may be employed also when money such as bills are used instead of part of kinds of coins.

What is claimed is:

1. A controller for a vending machine comprising:

a forced acceptance switch for setting a forced acceptance mode;

change lack detecting means for detecting lack of change in a vending machine;

control means for, in an ordinary mode in which the forced acceptance switch is inoperative, generating a selling enable signal when the amount of money of inserted coins coincides with a price of desired commodities or when the amount of money of inserted coins exceeds the price of the desired commodities and the change lack detecting means does not detect lack of change, and in the forced acceptance mode set by the operation of the forced acceptance switch, generating a selling enable signal when the amount of money of inserted coins coincides with or exceeds the price of the desired commodities irrespective of whether or not the change lack detecting means detects lack of change;

change paying means, when commodities are sold in response to the sell enable signal, for paying change corresponding to the amount of money of the inserted coins from which the price of the desired commodities is substracted, and in the forced acceptance mode, paying change as much as possible but not exceeding the amount of money of the inserted coins from which the price of the desired commodities is substracted.

2. A controller for a vending machine comprising:

first coin storage means for storing one or a plurality of kinds of inserted coins which are used for paying change;

second coin storage means for storing one or a plurality of kinds of inserted coins which are not used for paying change;

change lack detecting means provided at the first coin storage means for detecting lack of change when coins stored in the first coin storage means is below a predetermined value;

a forced acceptance switch for setting a forced acceptance mode;

control means for, in an ordinary mode in which the forced acceptance switch is inoperative, generating a selling enable signal when the amount of money of inserted coins coincides with a price of desired commodities or when the amount of money of inserted coins exceeds the price of the desired commodities and the change lack detecting means does not detect lack of change, and in the forced acceptance mode set by the operation of the forced acceptance switch, generating a selling enable signal when the amount of money of inserted coins coincides with or exceeds the price of the desired commodities irrespective of whether or not the change lack detecting means detects lack of change;

change paying means, when commodities are sold in response to the sell enable signal, for paying change by using coins stored in the first storage means corresponding to the amount of money of the inserted coins from which the price of the desired commodities is subtracted, and in the forced acceptance mode, paying change by using coins stored in the first coin storage means as much as possible but not exceeding the amount of money of the inserted coins from which the price of the desired commodities is subtracted.

3. The controller for a vending machine as defined in claim 2 wherein the first coin storage means comprises coin tubes for storing coins to be used as change for each denomination, and the second coin stage means comprises a cash box for storing coins overflowed from the coin tubes.

4. The controller for a vending machine as defined in claim 3 wherein the change paying means, in the ordinary mode, pays change by using the coins from the coin tube when the amount of the coins corresponds to the change, and in the forced acceptance mode, pays change until the coin tube becomes empty.

* * * * *